United States Patent [19]

Britton, Sr. et al.

[11] Patent Number: 4,856,070

[45] Date of Patent: Aug. 8, 1989

[54] RETRACTABLE 2 WAY MICROPHONE

[76] Inventors: Joe L. Britton, Sr., P.O. Box 30033, Houston, Tex. 77230; George Spector, 233 Broadway RM 3815, New York, N.Y. 10007

[21] Appl. No.: 75,639

[22] Filed: Jul. 20, 1987

[51] Int. Cl.[4] ..... H04R 1/02

[52] U.S. Cl. ..... 381/169; 381/87; 381/91; 242/107.2; 242/107.7

[58] Field of Search ..... 381/91, 87, 88, 120, 381/168, 169, 188; 379/428, 429, 431, 442; 439/528; 242/107.2, 107.7

[56] References Cited

U.S. PATENT DOCUMENTS

| | | | |
|---|---|---|---|
| 2,713,407 | 3/1953 | Miller | 242/107.2 |
| 4,062,608 | 12/1977 | Pierce | 379/442 |
| 4,577,070 | 3/1986 | Shulman | 381/169 |

FOREIGN PATENT DOCUMENTS

| | | | |
|---|---|---|---|
| 0128145 | 6/1919 | United Kingdom | 242/107.2 |

*Primary Examiner*—Donald J. Yusko
*Assistant Examiner*—Tyrone Queen

[57] ABSTRACT

An apparatus for retracting a microphone is provided and consists of a microphone holder affixed to a free end of a retractable chain from a spool within a housing whereby when an operator needs to transmit, the microphone is pulled away from the housing. When transmission is completed the chain will go back into the housing around the spool place the microphone back against the housing where it is safe from damage and out of the way. Modifications of the spool is provided to allow for different lengths of chain to be wrapped around the spool.

5 Claims, 1 Drawing Sheet

RETRACTABLE 2 WAY MICROPHONE

BACKGROUND OF THE INVENTION

The instant invention relates generally to cord storage devices and more specifically it relates to an apparatus for retracting a microphone.

Numerous cord storage devices have been provided in prior art that are adapted to hold the cords onto rotating reels within housing. For example, U.S. Pat. Nos. 2,197,691; 3,584,157 and 4,062,608 all are illustrative of such prior art. While these units may be suitable for the particular purpose to which they address, they would not be as suitable for the purposes of the present invention as heretofore described.

SUMMARY OF THE INVENTION

A primary object of the present invention is to provide an apparatus for retracting a microphone that will overcome the shortcomings of the prior art devices.

Another object is to provide an apparatus for retracting a microphone that will keep the microphone in a designed area when not in use where it will be safe from damage and out of the way of an operator.

An additional object is to provide an apparatus for retracting a microphone in which the retractable spool is designed to accommodate different lengths of chain that has a microphone holder at its free end thereof.

A further object is to provide an apparatus for retracting a microphone that is simple and easy to use.

A still further object is to provide an apparatus for retracting a microphone that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
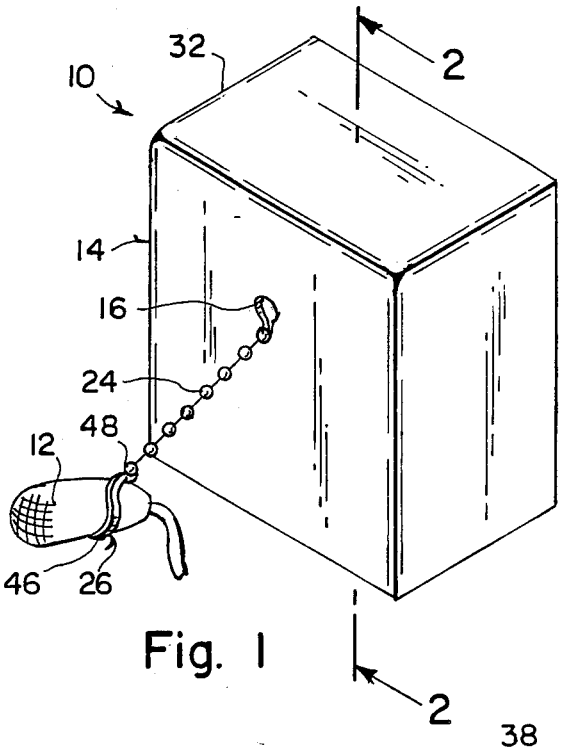
FIG. 1 is a perspective view of the invention.
Figure 2:
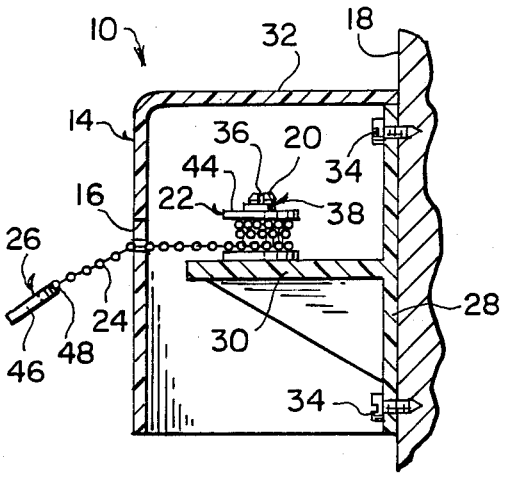
FIG. 2 is a cross sectional view taken along line 2—2 in FIG. 1.
Figure 3:
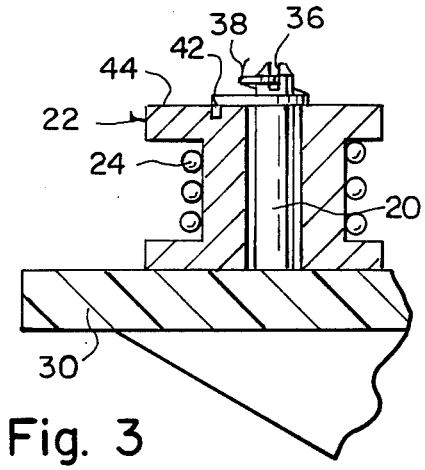
FIG. 3 is an enlarged cross sectional view of the retractable reel assembly in greater detail.
Figure 4:
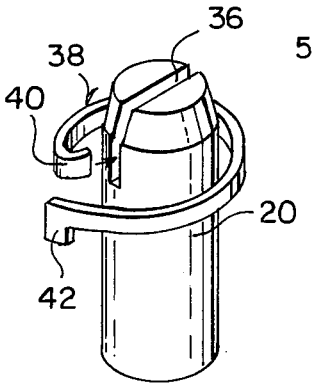
FIG. 4 is a perspective view of the spindle showing the spring entering the slot therein.

Turning now descriptively to the drawings, in which similar reference characters denote similar elements throughout the several views, FIGS. 1 through 4 illustrate an apparatus 10 for retracting a microphone 12 and consists of a housing 14 that has an aperture 16 therethrough whereby the housing 14 is secured to a supporting surface 18 such as a wall. A spindle 20 is secured within the housing 14 and a spool 22 is disposed onto the spindle 20. The spool 22 is rotatably biased in a preferred direction of rotation and is fixedly secured onto the spindle 20. An elongated chain 24 passes through the aperture 16 in the housing 14 and has one end secured to and wrapped around the spool 22. Aholder 26 is affixed to a free end of the chain 24 that extends through the aperture 16 so as to engage the microphone 12. When operator (not shown) needs to transmit, the microphone 12 is pulled outwardly away from the housing 14. When transmission is completed the spool 22 will automatically retract the chain 24 back into the housing 14 and place the microphone 12 back against the housing where it is safe from damage and out of the way of the operator.

The housing 14 includes a vertical mounting plate 28 that has a horizontal support 30 extending inwardly therefrom. A cover 32 fits over the mounting plate 28 with the aperture 16 being in the cover 32 and in an inverted 8-shaped configuration so as to allow the chain 24 to lock into smaller opering to keep the chain at different length intervals. Screws 34 extend through the mounting plate 28 and into the supporting surface 18. The spindle 20 has a slot 36 and is secured vertically onto the support 30 of the mounting plate 28. A flat spiral spring 38 has an inner end 40 placed into the slot 36 in the spindle 20 and an outer end 42 placed into top 44 of the spool 22. The holder 26 is a ring 46 that has a hook 48 to attach to free end of the chain 24 while the ring 46 fits around the microphone 12.

Figure 5:
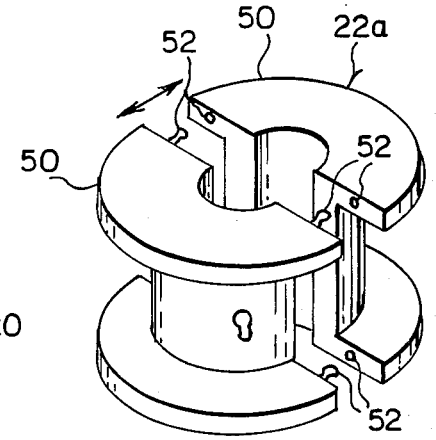
FIG. 5 is a perspective view of a modified spool vertically split into two removable spool halfs.

A modified spool **22*a* is shown in FIG. 5 and is vertically split into two removable halfs 50, with each half having one part of a ball and socket assembly 52 for holding the spool 22*a* together so that various sized flanged spools can be disposed onto the spindle 20 to accommodate various lengths of chain 24**.

Figure 6:
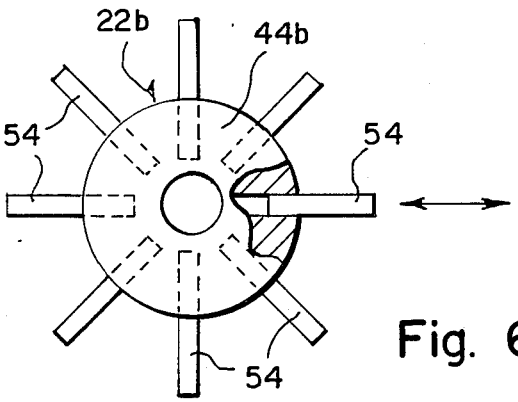
FIG. 6 is a top view of another modified spool having slideable radial rams to adjust to different lengths of chain.

FIG. 6 shows another modified spool **22*b* that includes a plurality of slideable radial arms 54 extending from top 46 and bottom (not shown) of the spool 22*b* so as to adjust to different lengths of chain 24** secured to and wrapped around the spool.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A retraction device for a microphone which comprises:

(a) a housing having an aperture therethrough;

(b) means for securing said housing to a supporting surface;

(c) a spindle fixedly secured within said housing;

(d) a spool disposed rotatably on said spindle;

(e) an elongated chain extending through the aperture in said housing having an inner end secured to said spool and wound around said spool;

(f) means rotatably biasing said spool in a preferred direction of rotation to automatically retract said chain when uncoiled;

(g) a microphone holder affixed to an outer end of said chain outward of said aperture whereby, an operator can manually pull the holder outwardly from the housing and then release the holder whereby said spool will automatically retract said chain back into said housing and retain the holder against said housing.

2. An apparatus as in claim 1, wherein (a) said spindle has a slot;

(b) said rotatably bias means being a spring encircling said spindle having an inner end placed into a slot in said spindle, and an outer end inserted into an indenture in the top of said spool; and (e) said holder being a ring having a hook to attach to the free end of said chain wherein said ring is adapted to fit engagingly around a microphone.

3. An apparatus as recited in claim 2, wherein said spool is vertically split into two removeable halfs, with each half having one part of a ball and socket assembly for holding said spool together so that various sized flanged spools can be disposed onto said spindle to accommodate various lengths of chain.

4. An apparatus as recited in claim 2, wherein said spool further includes means for adjusting the outer diameter of the spool whereby varying lengths of chain can be used.

5. An apparatus as in claim 4, wherein said means for adjusting the outer diameter comprises spaced radially extensible arms mounted in retaining channels in said spool.

* * * * *